US007001141B2

(12) United States Patent
Cervenka

(10) Patent No.: US 7,001,141 B2
(45) Date of Patent: Feb. 21, 2006

(54) COOLED NOZZLED GUIDE VANE OR TURBINE ROTOR BLADE PLATFORM

(75) Inventor: Michael O Cervenka, Derby (GB)

(73) Assignee: Rolls-Royce, PLC, London (GB)

( * ) Notice: Subject to any disclaimer, the term of this patent is extended or adjusted under 35 U.S.C. 154(b) by 61 days.

(21) Appl. No.: 10/830,110

(22) Filed: Apr. 23, 2004

(65) Prior Publication Data

US 2004/0247435 A1 Dec. 9, 2004

(30) Foreign Application Priority Data

Jun. 4, 2003 (GB) ..... 0312867

(51) Int. Cl.
*F01D 9/06* (2006.01)

(52) U.S. Cl. ..... 415/115

(58) Field of Classification Search ..... 415/115, 415/116; 416/95, 96 R, 96 A, 97 R
See application file for complete search history.

(56) References Cited

U.S. PATENT DOCUMENTS 4,040,767 A 8/1977 Dierberger et al.
4,359,310 A * 11/1982 Endres et al. ..... 415/115
4,712,979 A * 12/1987 Finger ..... 416/96 R
5,201,847 A * 4/1993 Whidden ..... 415/177
5,252,026 A * 10/1993 Shepherd ..... 415/115
5,320,485 A * 6/1994 Bourguignon et al. ..... 415/115
5,344,283 A 9/1994 Magowan et al.
5,382,135 A * 1/1995 Green ..... 416/97 R
5,413,458 A * 5/1995 Calderbank ..... 415/115
5,915,923 A * 6/1999 Tomita et al. ..... 416/96 R
6,254,333 B1 7/2001 Merry
6,508,620 B1 1/2003 Sreekanth et al.
6,830,427 B1 * 12/2004 Lafarge et al. ..... 415/115

FOREIGN PATENT DOCUMENTS

EP 0 937 863 A3 8/1999
JP A 11-257003 9/1999

* cited by examiner

*Primary Examiner*—Christopher Verdier
(74) *Attorney, Agent, or Firm*—Oliff & Berridge, PLC

(57) ABSTRACT

A turbine aerofoil for a gas turbine has a pressure wall and suction wall and at least one internal cavity. An aerofoil platform adjacent and generally perpendicular to the aerofoil has at least one internal cavity with a pressure wall and suction wall on respective sides of the cavity. The cavity is divided into at least two cooling chambers including a first chamber for receiving cooling air for the platform pressure wall and a second chamber for receiving cooling air for cooling the platform suction wall. The first chamber is in flow communication with the aerofoil cavity for discharge of at least part of the cooling air entering the first chamber to the aerofoil cavity.

9 Claims, 2 Drawing Sheets

(Prior Art)

COOLED NOZZLED GUIDE VANE OR TURBINE ROTOR BLADE PLATFORM

This invention relates to cooled nozzled guide vanes and/or turbine rotor blades for gas turbine engines, and in particular concerns under platform impingement cooling of turbine guide vanes or rotor blades.

As gas turbine engine turbine entry temperatures have increased it has become necessary to use greater amounts of cooling air from the engine compressor to cool turbine nozzle guide vane and rotor blade components. Engine cycle efficiency is affected by the amount of compressor air that is used for cooling purposes and therefore it is necessary to reduce the amount of air used for cooling by increasing the cooling effectiveness of the cooling air.

As turbine entry temperatures have increased to the levels seen in today's engines it has been necessary to cool aerofoil platforms in addition to the aerofoil of a turbine nozzle guide vane or rotor blade. One arrangement that is currently used provides a single platform cavity that is fed with cooling air from an adjacent plenum space. Cooling air is directed into the cavity through a plurality of holes provided in a platform wall between the cavity and the plenum to provide impingement cooling of the platform. In this arrangement the cooling air is generally exhausted through film cooling holes in the upper platform surface, that is to say the gas washed surface of the platform, or via trailing edge platform slots. Cooling enhancement features, for example pedestals, are often provided in the platform cavity to promote turbulent flow and increase the heat transfer surface area. In known arrangements the platform exhaust flow may be used to feed or top up the cooling airflow into the aerofoil section. This presents particular problems since the cooling air exiting the platform cavity must have sufficient residual pressure to pass through the air cooling cavity or cavities of the aerofoil. This can result in relatively weak impingement cooling of the platform since the pressure loss available for impingement cooling of the platform is therefore relatively low. This leads to an increased cooling flow requirement. In addition in arrangements where platform film cooling holes are positioned on the suction side of the platform most of the pressure drop occurs through the film cooling holes, leading to excessive blowing rates and inefficient use of the cooling air. High blowing rates also increase aerodynamic losses of the aerofoil.

Another problem associated with the above mentioned single cavity type under platform cooling arrangement is that aerofoil platforms generally tend to burn towards the rear, or aerofoil trailing edge, end of the platform, particularly just downstream of the aerofoil trailing edge. The pressure of the hot turbine gases is very low at this position and therefore if the platform is perforated due to burning at this point the platform cooling air will tend to exhaust through the platform, significantly reducing the amount of cooling air flowing through the aerofoil and potentially resulting in overheating at the aerofoil and premature failure of the nozzle guide vane or rotor blade component.

There is a requirement therefore for improved aerofoil platform cooling where platform cooling air is, at least partly, fed into the aerofoil cavity of a gas turbine nozzle guide vane or turbine rotor blade.

According to an aspect of the invention there is provided a nozzle guide vane or turbine rotor blade for a gas turbine engine; the said vane or blade comprising an aerofoil having a pressure wall and a suction wall and at least one aerofoil internal cavity between the pressure and suction walls for conveying cooling air through the aerofoil, and at least one aerofoil platform adjacent and generally perpendicular to the aerofoil, the platform having at least one internal cavity with a platform pressure wall on the pressure wall side of the aerofoil on the aerofoil side of the platform cavity, and a platform suction wall on the suction wall side of the aerofoil on the aerofoil side of the platform cavity, the platform cavity being divided into at least two chambers no direct flow path therebetween including a first chamber for receiving cooling air for cooling the said platform pressure wall and a second chamber for receiving cooling air for cooling the said platform suction wall, wherein the said first cavity is in flow communication with the said aerofoil cavity for discharge of at least part of the cooling air entering the first chamber to the said aerofoil cavity. In this arrangement the nozzle guide vane or turbine rotor blade comprises an under platform cavity divided into at least two sections, the first of which feeds the aerofoil cavity to provide a top up flow for aerofoil cooling.

Preferably, a plurality of impingement cooling holes are provided in a wall on an opposite side of the platform cavity to the platform pressure and suction walls for cooling the said platform pressure and suction walls by the impingement of cooling air admitted, in use, into the said cavity through the impingement cooling holes from a common source, including a first set of impingement cooling holes for conveying cooling air into the said first chamber and a second set of impingement cooling holes for conveying cooling air into the said second chamber. In this way cooling effectiveness of the cooling air can be optimised.

Preferably, the first and second sets of impingement cooling holes are sized and spaced such that, in use, the cooling air admitted to the first chamber has a higher operational pressure than the cooling air admitted to the second chamber. In this way the pressure differential across the first set of impingement cooling holes can be optimised so that the cooling air is of sufficient pressure to be admitted into the aerofoil cavity from the platform cavity while the second set of cooling holes can be optimised for impingement cooling of the aerofoil platform suction wall. In the first chamber under platform impingement cooling is less effective but is compensated by the higher flow rate of cooling air required for aerofoil cooling. In the second chamber there is a higher operational pressure difference so that impingement cooling is more effective which readily enables the flow rate of cooling air to be reduced in accordance with the cooling requirements of the platform suction wall. In the embodiments of the present invention it will be understood that the turbine component being cooled fails safe in the event of heat/erosion damage to its platform trailing edge, since aerofoil cooling is not affected if the trailing edge of the platform is damaged as there is no direct flow path from the first chamber to the second.

In preferred embodiments, the first and second sets of impingement cooling holes are sized and spaced such that, in use, the flow of cooling air through the first holes into the first chamber is greater than the flow of cooling air through the second holes into the second chamber. In this way it is possible to increase the cooling effectiveness of the cooling air taken from the compressor because the amount of cooling air fed to the first chamber and then the aerofoil can be optimised for cooling those parts of the component independently of the amount of cooling air required for cooling the suction wall of the platform.

In preferred embodiments, the second chamber comprises a plurality of cooling air exit apertures at a downstream, or trailing edge, end of the platform. Preferably the exit apertures comprise a plurality of cooling air exhaust slots. As the second set of impingement holes has a significant pressure drop, and therefore higher heat transfer capability, the amount of cooling air required is significantly less than the first set of holes and hence the cooling air in the second chamber can be exhausted, or dumped, directly through the trailing edge slots in the platform.

Preferably, the said platform pressure wall is provided with a plurality of film cooling holes for conveying cooling air from the first chamber to the external surface of the platform pressure wall to provide a film of cooling air over the said external surface in use. Thus the present invention contemplates embodiments where the external surface of the platform pressure wall in the turbine gas flow path is provided with an arrangement of film cooling holes to protect the external pressure surface of the platform from the high temperature turbine gases.

Preferably, the said platform suction wall is provided with a plurality of film cooling holes for conveying cooling air from the second chamber to the external surface of the platform suction wall to provide a film of cooling air over the said external surface in use. In this way the external surface of the platform suction wall is additionally or alternatively provided with an arrangement of film cooling holes for protecting the suction surface of the platform from the effects of the high temperature turbine gasses.

The present invention also contemplates embodiments of a nozzle guide vane or turbine rotor blade comprising first and second platforms at opposite spanwise ends of the aerofoil for forming radially inner and outer shrouds in an array of circumferentially spaced nozzle guide vane or turbine rotor blades in a gas turbine engine. Thus, the invention contemplates shrouded and unshrouded turbine rotor blades and nozzle guide vanes.

Preferably, the nozzle guide vane or turbine rotor blade further comprises a plurality of projections in the first and/or second chambers. These projections may be provided for increasing turbulence within the platform chambers and/or increasing the surface area within the chambers for enhanced heat transfer performance.

Various embodiments of the invention will now be more particularly described, by way of example, with reference to the accompanying drawings, in which.

Figure 1:
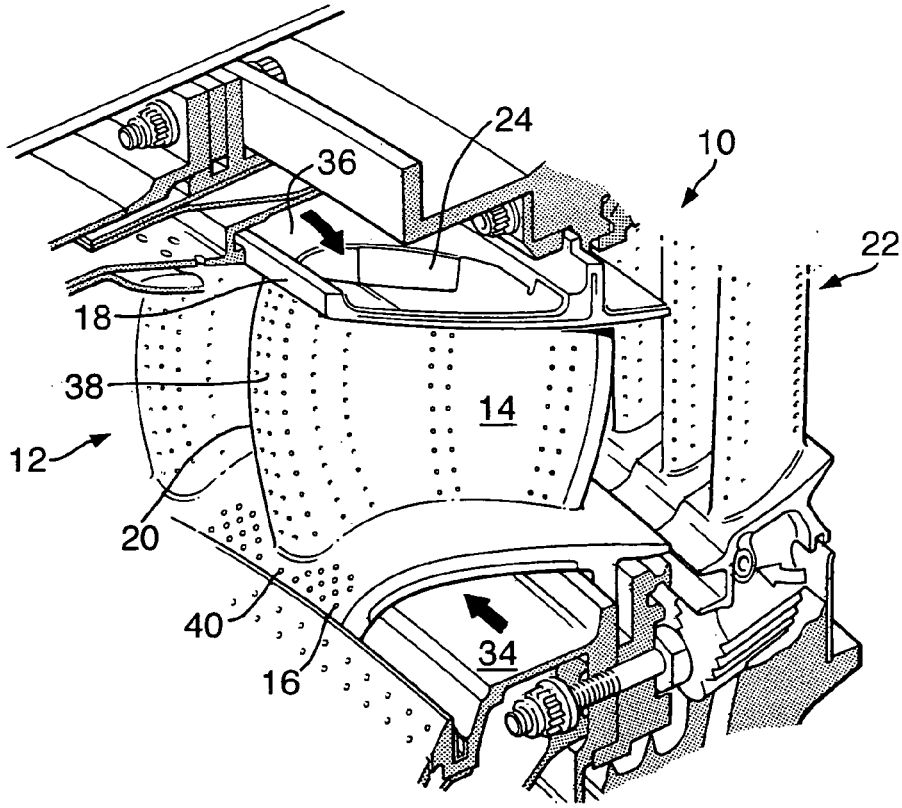
FIG. 1 is a perspective view of a gas turbine nozzle guide vane with under platform cooling.

Referring to FIG. 1, a turbine stage 10 of a turbine section in a gas turbine engine is shown. The turbine stage comprises an array of nozzle guide vanes segments 12 circumferentially spaced about the engine axis to define an annular gas flow passage 14 between radially inner and outer platforms 16 and 18 with an aerofoil section 20 extending radially across the gas flow passage 14 in a radial direction substantially perpendicular to the platforms 16 and 18. The nozzle guide vanes 12 are arranged upstream of an array of turbine rotor blades 22 such that turbine gases passing between the aerofoil sections of the vanes is directed at an appropriate angle on to the turbine rotor blade aerofoils.

Figure 2:
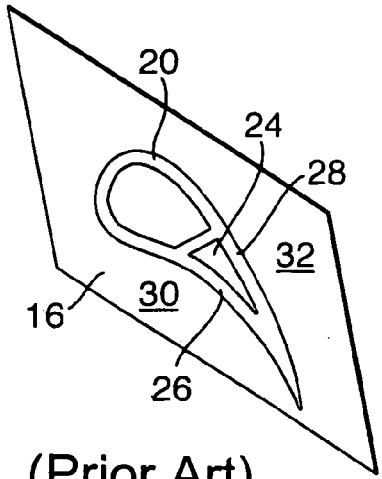
(Prior Art) Fig.2.
FIG. 2 is a cross section view of the nozzle guide vane platform of FIG. 1.

As can best be seen in the cross section view of FIG. 2 the aerofoil section of each vane is substantially hollow including an internal cavity 24 for conveying cooling air through the aerofoil section with a pressure wall 26 on the pressure side of the aerofoil and a suction wall 28 on the other side of the aerofoil section. The platform similarly has a pressure side 30 and suction side 32 on respective pressure and suction sides of the aerofoil cross-section.

In the arrangement of FIG. 1 cooling air enters the aerofoil cavity 24 from a plenum region 34 on the underside of the vane inner platform and also from a plenum region 36 on the radially outer side of the outer platform. Cooling air entering the internal cavity 24 flows on to the aerofoil surfaces through rows of film cooling holes 38 provided in the aerofoil and also on to the platform surfaces in contact with the turbine gases through film cooling holes 40. In the case of the known arrangement in FIG. 1 the film cooling holes 40 are fed directly from the plenum region 34 on the underside of the inner platform.

Figure 3:
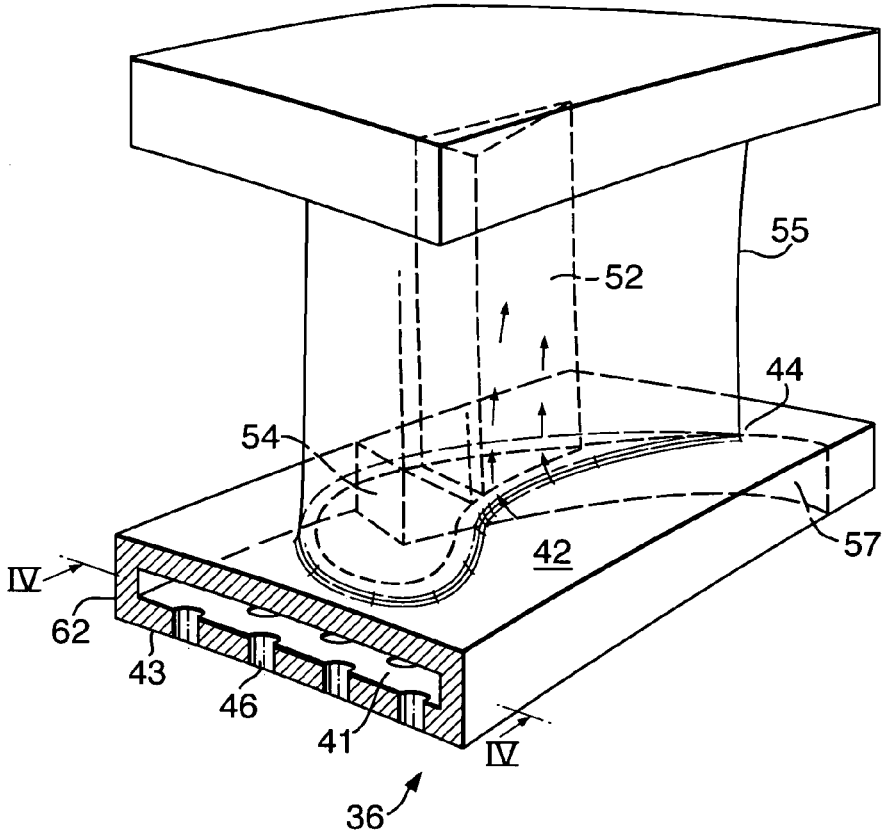
FIG. 3 is a perspective part cut-away view of a nozzle guide vane according to an embodiment of the invention.

Referring now to the embodiment shown in FIG. 3. In the drawing of FIG. 3 a single nozzle guide vane 12 is shown with the leading edge end of the inner platform cut-away for the purpose of illustrating the inner platform 16 an inner platform internal cavity 41. The inner platform comprises a pressure wall 42 and a suction wall 44 on the respective pressure and suction sides of the aerofoil on the aerofoil side of the cavity. The other side of the platform comprises an under platform wall 43 which is provided with a plurality of impingement cooling holes 46 for directing cooling air admitted from the plenum region 36 into the platform cavity 41 as high velocity impingement jets against the platform pressure and suction wall surfaces in the cavity.

Figure 4:
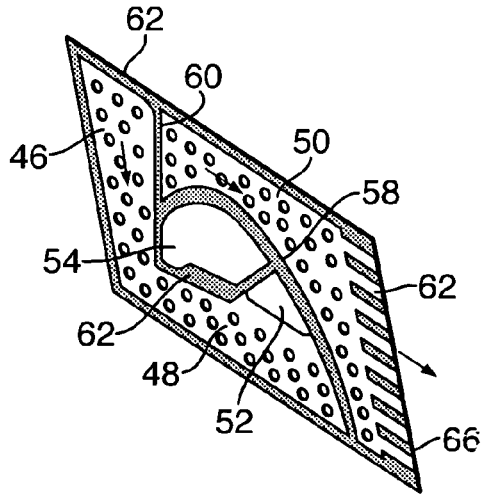
FIG. 4 is a cross-section view of the inner platform of the nozzle guide vane of FIG. 3, along line IV—IV.

As can best be seen in the drawing of FIG. 4 the platform cavity is divided into two chambers, including a first chamber 48 for receiving cooling air from the plenum 36 for cooling the platform pressure wall 42, and a second chamber 50 for receiving cooling air also from the plenum 36 for cooling the platform suction wall 44. The first chamber 48 is in flow communication with an aerofoil section cavity 52 which is positioned adjacent to a leading edge aerofoil section internal cavity 54 and the aerofoil trailing edge 55. The platform cavity is divided by means of a first internal wall 58 which is substantially coincident with the aerofoil suction wall in the spanwise direction of the vane and a second wall 60 which extends from an aerofoil leading edge region of the wall 58 to the suction side edge 62 of the platform.

The cavity dividing walls 58 and 60 divide the cavity into the two chambers 48 and 50 with the chamber 48 occupying the region forward of the aerofoil leading edge and the region of the pressure wall 42, while the chamber 50 occupies the aerofoil trailing edge region and the suction surface wall 44. A further wall 62 is provided in the cavity 41 around the pressure surface side of the leading edge internal aerofoil cavity 54. The aerofoil cavity 54 is fed independently of the platform cavity chambers 48 and 50 with cooling air directly from the plenum region 36 on the underside of the platform.

The division of the cavity 41 is shown schematically in the drawing of FIG. 3 where the 3-D hatched block 57 represents the part of the platform corresponding to the region of the second chamber 50.

The size, shape and spacing of the impingement holes 46 into the chamber 48 is such that the holes generate relatively weak impingement jets of cooling air against the platform pressure wall 42 on the opposite side of the chamber, that is to say the pressure drop across the holes is relatively small in comparison to the overall pressure of the cooling air admitted into the chamber 48 from the plenum 36. In contrast the impingement holes 46 that feed the trailing edge cavity 50 are of a shape, size and spacing suitable for generating relatively high velocity impingement jets of cooling air against the platform suction and trailing edge wall 44. The relatively high pressure drop across the holes 46 in the chamber 50 enables a relatively low flow of cooling fluid to be used to cool the platform suction and trailing edge wall 44. The cooling air entering the second chamber 50 exits the chamber through an array of parallel exhaust slots 62 in the trailing edge 66 of the platform. The cooling air entering the first chamber 48 exits the chamber with a relatively high pressure into the aerofoil internal cavity 52 through which it is conveyed with its thermal capacity being used to cool the aerofoil suction and pressure walls as it flows along the aerofoil section.

In the embodiment described with reference to FIGS. 3 and 4 it will be seen that the suction side of the platform cooling air is exhausted through the trailing edge slots 62 while the pressure side platform cooling air exhausts into the cavity 52 in the aerofoil. In this way the air from the chamber 48 is used to supplement the main aerofoil cooling air before being exhausted through film cooling holes or trailing edge slots in the aerofoil section. The pressure side platform cooling air in the chamber 48 may, in other embodiments (not shown), exhaust through film cooling holes in the platform pressure wall 42. In order to avoid ingestion of the turbine gases through these film-cooling holes the cooling air pressure in the cavity chamber 48 is maintained higher than the pressure of the turbine gases acting on the platform wall 42. The pressure drop over the impingement holes 46 which admit the cooling air into the chamber 48 is therefore relatively low so that a relatively high pressure can be maintained in the chamber 48. In order to maintain the cooling effectiveness of the chamber 48 the flow rate of cooling air into this region is relatively high. In the present invention this cooling air is used to further cool the aerofoil section rather than being discarded since the cooling air has additional thermal capacity for cooling the aerofoil once it has been used for impingement cooling of the platform pressure wall.

Film cooling holes (not shown) may also be provided in the suction wall 44 of the platform. In contrast to the film cooling holes which may be provided in the pressure wall, the film cooling holes in the suction wall exhaust at a much lower pressure. The impingement holes 46 that admit cooling air into the suction side platform chamber have a much greater pressure drop for generating relatively high velocity impingement jets of cooling air compared with the holes in the chamber 48. As the cooling air requirement of the chamber 50 is relatively low the cooling air admitted into this chamber can be exhausted through the platform trailing edge slots 62 without significant reduction in cooling effectiveness.

Although aspects of the invention have been described with reference to the embodiments shown in the accompanying drawings, it is to be understood that the invention is not limited to those precise embodiments and that various changes and modifications may be affected without further inventive skill and effort. For example, the invention contemplates embodiments where the cooled aerofoil platform is part of a turbine rotor blade or a nozzle guide vane. In addition the invention contemplates embodiments where both the inner and outer platforms of a nozzle guide vane are provided with an impingement cooling arrangement as described with reference to the inner platform in the drawing of FIG. 3.

What is claimed is:

1. A nozzle guide vane or turbine rotor blade for a gas turbine engine; the vane or blade comprising an aerofoil having a pressure wall and a suction wall and at least one aerofoil internal cavity between the pressure and suction walls for conveying cooling air through the aerofoil, and at least one aerofoil platform adjacent and generally perpendicular to the aerofoil, the at least one aerofoil platform having at least one internal platform cavity with a platform pressure wall on a pressure wall side of the aerofoil and on an aerofoil side of the platform cavity, and a platform suction wall on a suction wall side of the aerofoil and on the aerofoil side of the platform cavity, the platform cavity being divided into at least two chambers with no direct flow path therebetween, including a first chamber for receiving cooling air for cooling the platform pressure wall and a second chamber for receiving cooling air for cooling the platform suction wall, wherein the first chamber is in flow communication with the aerofoil cavity for discharging at least part of the cooling air entering the first chamber to the aerofoil cavity, and a plurality of impingement cooling holes are provided in a wall on an opposite side of the platform cavity to the platform pressure wall and the platform suction wall for cooling the platform pressure wall and the platform suction wall by the impingement of cooling air admitted, in use, into the platform cavity through the impingement cooling holes from a common source, including a first set of impingement cooling holes for conveying cooling air into the first chamber and a second set of impingement cooling holes for conveying cooling air into the second chamber.

2. A nozzle guide vane or turbine rotor blade as claimed in claim 1, wherein the first and second sets of impingement cooling holes are sized and spaced such that, in use, cooling air admitted to the first chamber has a higher operational pressure than cooling air admitted to the second chamber.

3. A nozzle guide vane or turbine rotor blade as claimed in claim 1, wherein the first and second sets of impingement cooling holes are sized and spaced such that, in use, a flow of cooling air through the first holes into the first chamber is greater than the flow of cooling air through the second holes into the second chamber.

4. A nozzle guide vane or turbine rotor blade as claimed claim 1, wherein the second chamber comprises a plurality of cooling air exit apertures at a downstream, or trailing edge, end of the platform.

5. A nozzle guide vane or turbine rotor blade as claimed in claim 4, herein the exit apertures comprise a plurality of cooling air exhaust slots.

6. A nozzle guide vane or turbine rotor blade as claimed in claim 1, wherein the platform pressure wall is provided with a plurality of film cooling holes for conveying cooling air from the first chamber to the external surface of the platform pressure wall to provide a film of cooling air over the external surface in use.

7. A nozzle guide vane or turbine rotor blade as claimed in claim 1, herein the platform suction wall is provided with a plurality of film cooling holes for conveying cooling air from the second chamber to the external surface of the platform suction wall to provide a film of cooling air over the external surface in use.

8. A nozzle guide vane or turbine rotor blade as claimed in claim 1, comprising first and second platforms at opposite spanwise ends of the aerofoil for forming radially inner and outer shrouds in an array of circumferentially spaced nozzle guide vanes or turbine rotor blades in the gas turbine engine.

9. A nozzle guide vane or turbine rotor blade as claimed in claim 1, further comprising a plurality of projections in the first and/or second chambers ng the surface cooling area of the first and/or second chamber.

* * * * *